US011401763B2

(12) United States Patent
Al-Mousa et al.

(10) Patent No.: US 11,401,763 B2
(45) Date of Patent: Aug. 2, 2022

(54) CUTTING A SIDETRACK WINDOW IN A CASED WELLBORE

(71) Applicant: Saudi Arabian Oil Company, Dhahran (SA)

(72) Inventors: Ahmed Al-Mousa, Dhahran (SA); Marius Neacsu, Dhahran (SA); Ahmed A. Al-Ramadhan, Dammam (SA)

(73) Assignee: Saudi Arabian Oil Company, Dhahran (SA)

( * ) Notice: Subject to any disclaimer, the term of this patent is extended or adjusted under 35 U.S.C. 154(b) by 351 days.

(21) Appl. No.: 16/544,364

(22) Filed: Aug. 19, 2019

(65) Prior Publication Data

US 2021/0054708 A1 Feb. 25, 2021

(51) Int. Cl.

| | |
|---|---|
| ***E21B 29/06*** | (2006.01) |
| ***E21B 33/129*** | (2006.01) |
| ***E21B 33/13*** | (2006.01) |
| *E21B 7/06* | (2006.01) |

(52) U.S. Cl.

CPC ..... *E21B 29/06* (2013.01); *E21B 33/129* (2013.01); *E21B 33/13* (2013.01); *E21B 7/061* (2013.01)

(58) Field of Classification Search

CPC ..... E21B 17/06

See application file for complete search history.

(56) References Cited

U.S. PATENT DOCUMENTS

| | | | | |
|---|---|---|---|---|
| 2,222,233 A | | 11/1940 | Mize | |
| 2,672,199 A | | 3/1954 | McKenna | |
| 3,116,799 A | | 1/1964 | Lemons | |
| 4,624,312 A | * | 11/1986 | McMullin | E21B 33/05 166/153 |
| 5,806,596 A | | 9/1998 | Hardy et al. | |
| 6,595,289 B2 | | 7/2003 | Tumlin et al. | |
| 10,280,706 B1 | | 5/2019 | Sharp, III | |
| 2013/0213654 A1 | * | 8/2013 | Dewey | E21B 17/06 166/285 |

OTHER PUBLICATIONS

PCT International Search Report and Written Opinion in International Appln. No. PCT/US2020/046754, dated Nov. 3, 2020, 14 pages.

Bruton et al., "Whipstock Options for Sidetracking," Oilfield Review, vol. 26, No. 1, Spring 2014, 10 pages.

* cited by examiner

*Primary Examiner* — William D Hutton, Jr.
*Assistant Examiner* — Avi T Skaist
(74) *Attorney, Agent, or Firm* — Fish & Richardson P.C.

(57) ABSTRACT

A sidetrack window is cut in a cased wellbore by disposing a sidetracking assembly within the cased wellbore. A first ball is deployed into a drill string of the sidetracking assembly. The first ball leaves the drill string and lands on a ball seat of a cement retainer to block fluid outlet of the cement retainer. Then, the cement retainer is set and a second fluid outlet of the cement retainer is exposed. Cement is flowed through the drill string to the portion of the cased wellbore downstream of the cement retainer to plug the portion of the wellbore. The whipstock assembly is separated from the cement retainer. A second ball is deployed inside the drill string to land on the seat of the whipstock assembly to block a fluid outlet of the whipstock assembly. The whipstock assembly is anchored in the cased wellbore and the milling system is actuated to begin cutting the sidetrack window.

20 Claims, 6 Drawing Sheets

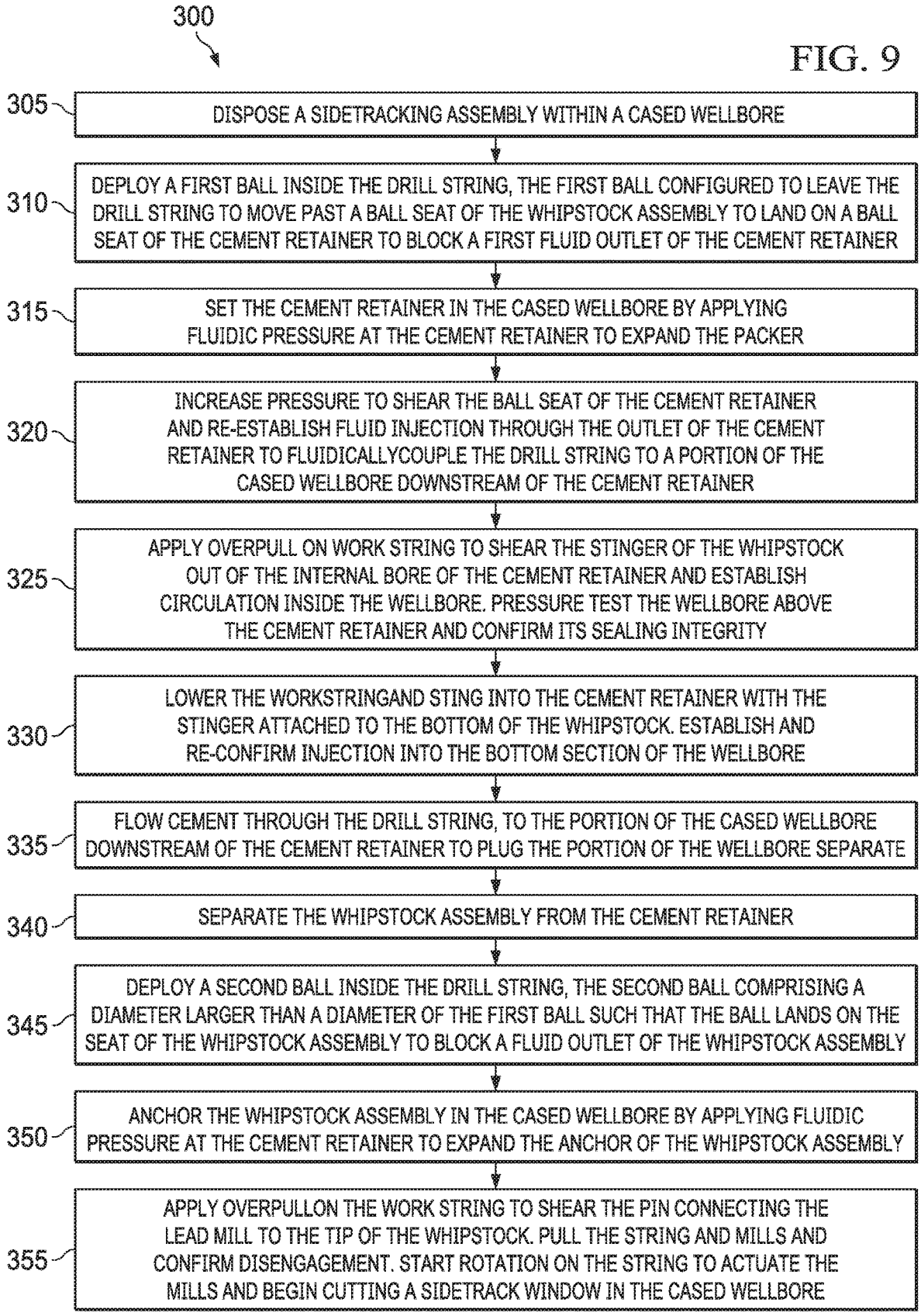
300
FIG. 9
305
DISPOSE A SIDETRACKING ASSEMBLY WITHIN A CASED WELLBORE
310
DEPLOY A FIRST BALL INSIDE THE DRILL STRING, THE FIRST BALL CONFIGURED TO LEAVE THE DRILL STRING TO MOVE PAST A BALL SEAT OF THE WHIPSTOCK ASSEMBLY TO LAND ON A BALL SEAT OF THE CEMENT RETAINER TO BLOCK A FIRST FLUID OUTLET OF THE CEMENT RETAINER
315
SET THE CEMENT RETAINER IN THE CASED WELLBORE BY APPLYING FLUIDIC PRESSURE AT THE CEMENT RETAINER TO EXPAND THE PACKER
320
INCREASE PRESSURE TO SHEAR THE BALL SEAT OF THE CEMENT RETAINER AND RE-ESTABLISH FLUID INJECTION THROUGH THE OUTLET OF THE CEMENT RETAINER TO FLUIDICALLYCOUPLE THE DRILL STRING TO A PORTION OF THE CASED WELLBORE DOWNSTREAM OF THE CEMENT RETAINER
325
APPLY OVERPULL ON WORK STRING TO SHEAR THE STINGER OF THE WHIPSTOCK OUT OF THE INTERNAL BORE OF THE CEMENT RETAINER AND ESTABLISH CIRCULATION INSIDE THE WELLBORE. PRESSURE TEST THE WELLBORE ABOVE THE CEMENT RETAINER AND CONFIRM ITS SEALING INTEGRITY
330
LOWER THE WORKSTRINGAND STING INTO THE CEMENT RETAINER WITH THE STINGER ATTACHED TO THE BOTTOM OF THE WHIPSTOCK. ESTABLISH AND RE-CONFIRM INJECTION INTO THE BOTTOM SECTION OF THE WELLBORE
335
FLOW CEMENT THROUGH THE DRILL STRING, TO THE PORTION OF THE CASED WELLBORE DOWNSTREAM OF THE CEMENT RETAINER TO PLUG THE PORTION OF THE WELLBORE SEPARATE
340
SEPARATE THE WHIPSTOCK ASSEMBLY FROM THE CEMENT RETAINER
345
DEPLOY A SECOND BALL INSIDE THE DRILL STRING, THE SECOND BALL COMPRISING A DIAMETER LARGER THAN A DIAMETER OF THE FIRST BALL SUCH THAT THE BALL LANDS ON THE SEAT OF THE WHIPSTOCK ASSEMBLY TO BLOCK A FLUID OUTLET OF THE WHIPSTOCK ASSEMBLY
350
ANCHOR THE WHIPSTOCK ASSEMBLY IN THE CASED WELLBORE BY APPLYING FLUIDIC PRESSURE AT THE CEMENT RETAINER TO EXPAND THE ANCHOR OF THE WHIPSTOCK ASSEMBLY
355
APPLY OVERPULLON THE WORK STRING TO SHEAR THE PIN CONNECTING THE LEAD MILL TO THE TIP OF THE WHIPSTOCK. PULL THE STRING AND MILLS AND CONFIRM DISENGAGEMENT. START ROTATION ON THE STRING TO ACTUATE THE MILLS AND BEGIN CUTTING A SIDETRACK WINDOW IN THE CASED WELLBORE

CUTTING A SIDETRACK WINDOW IN A CASED WELLBORE

FIELD OF THE DISCLOSURE

This disclosure relates to drilling wellbores, and more particularly to drilling sidetrack wellbores.

BACKGROUND OF THE DISCLOSURE

A sidetrack wellbore is a secondary, deviated wellbore that extends from a main wellbore. Sidetrack wellbores can be used to extract hydrocarbons from an alternate subterranean zone or formation, or to remedy a problem existing in the main wellbore. To drill a sidetrack wellbore, the existing open hole or perforations from main wellbore is plugged with cement and then a whipstock is used to deflect a drill bit from the cement plug, from above of plugged main wellbore. The whipstock allows the drill bit to drill a sidetrack wellbore in a desired direction and location with respect to the main wellbore.

SUMMARY

This disclosure describes cutting a sidetrack window in a cased wellbore.

Certain aspects of the subject matter described here can be implemented as a method. A sidetracking assembly is disposed within a cased wellbore. The sidetracking assembly is fluidically coupled to a drill string configured to receive fluid from or near a surface of the wellbore. The drill string is attached to a milling system. The sidetracking assembly includes a cement retainer and a whipstock assembly releasably and fluidically coupled to the cement retainer and disposed between the cement retainer and the drill string. The whipstock assembly includes an anchor activable by fluidic pressure and the cement retainer includes a packer activable by fluidic pressure. A first ball is deployed inside the drill string. The first ball is configured to leave the drill string to move past a ball seat of the whipstock assembly to land on a ball seat of the cement retainer to block a first fluid outlet of the cement retainer. With the fluid outlet of the cement retainer blocked, the cement retainer is set in the cased wellbore by applying fluidic pressure at the cement retainer to expand the packer. A second fluid outlet of the cement retainer is exposed to fluidically couple the drill string to a portion of the cased wellbore downstream of the cement retainer. Cement is flowed through the drill string to the portion of the cased wellbore downstream of the cement retainer to plug the portion of the wellbore. The whipstock assembly is separated from the cement retainer. A second ball is deployed inside the drill string. The second ball includes a diameter larger than a diameter of the first ball such that the second ball lands on the seat of the whipstock assembly to block a fluid outlet of the whipstock assembly. With the fluid outlet of the whipstock assembly blocked, the whipstock assembly is anchored in the cased wellbore by applying fluidic pressure at the cement retainer to expand the anchor of the whipstock assembly. With the whipstock assembly anchored on the cased wellbore, the milling system is actuated to begin cutting a sidetrack window in the cased wellbore.

An aspect combinable with any other aspect can include the following features. Prior to flowing cement through the drill string, the whipstock assembly is separated from the cement retainer and the cement retainer is pressure tested.

An aspect combinable with any other aspect can include the following features. After separating the whipstock assembly from the cement retainer and prior to deploying the second ball, the whipstock assembly is positioned at a desired location along the cased wellbore upstream of the cement retainer.

An aspect combinable with any other aspect can include the following features. Prior to actuating the milling system, the drill string is separated from the whipstock assembly.

An aspect combinable with any other aspect can include the following features. The whipstock assembly is releasably coupled to the drill string through a stinger of the whipstock assembly. To actuate the milling system of the drill string the stinger of the whipstock assembly is milled with the milling system.

An aspect combinable with any other aspect can include the following features. To set the cement retainer, a first fluid is flowed through the drill string to apply fluidic pressure at the cement retainer to expand the packer of the cement retainer and set the cement retainer in the cased wellbore.

An aspect combinable with any other aspect can include the following features. To anchor the whipstock assembly, a second fluid is flowed through the drill string to apply fluidic pressure at the whipstock assembly to expand the anchor of the cement retainer and anchor the whipstock assembly in the cased wellbore.

An aspect combinable with any other aspect can include the following features. To expose the outlet of the cement retainer, the first fluid is flowed to move the ball seat away from the cement retainer and an outlet of the cement retainer is exposed to fluidically couple the drill string to the portion of the cased wellbore downstream of the cement retainer.

An aspect combinable with any other aspect can include the following features. To separate the whipstock assembly from the cement retainer, the whipstock assembly is pulled away from the cement retainer to shear off an outlet of the whipstock assembly from the cement retainer.

Certain aspects of the subject matter described here can be implemented as a well system for cutting a sidetrack window in a cased wellbore system. The system includes a drill string, a sidetracking assembly and a whipstock assembly. The drill string is configured to receive fluid from or near a surface of the wellbore and is coupled to a milling system. The sidetracking assembly is fluidically coupled to the drill string. The sidetracking assembly is configured to form a cement plug to allow the milling system to cut a window in the cased wellbore. The sidetracking assembly includes a cement retainer including a packer activable by fluidic pressure. The cement retainer includes a first ball seat configured to support a first ball configured to block a first fluid outlet of the cement retainer to allow fluidic pressure at the string to expand the packer to set the cement retainer in the wellbore. The whipstock assembly is releasably and fluidically coupled to the cement retainer and disposed between the cement retainer and the drill string. The whipstock assembly is configured to separate from the cement retainer to allow the well system to do at least one of 1) pressure test the cement retainer and 2) anchor the whipstock assembly in the wellbore after flowing cement downstream of the cement retainer to plug the wellbore. The whipstock assembly includes an anchor activable by fluidic pressure. The whipstock assembly includes a second ball seat comprising a second fluid outlet sized to allow the first ball to pass through the second fluid outlet but stop a second ball larger than the first ball. The second ball is configured to block the second fluid outlet of the whipstock assembly to allow fluidic pressure at the drill string to expand the anchor to anchor the whipstock assembly in the wellbore.

An aspect combinable with any other aspect can include the following features. The whipstock assembly is releasably coupled to the cement retainer.

An aspect combinable with any other aspect can include the following features. The the packer of the cement retainer is designed at a shear rating pressure value permitting the packer to be expanded by fluid pressure without shearing off the first ball seat.

An aspect combinable with any other aspect can include the following features. The anchor of the whipstock assembly is configured such that the anchor is activable by a fluidic pressure larger than the fluidic pressure that activates the packer of the cement retainer.

An aspect combinable with any other aspect can include the following features. The cement retainer includes an internal sleeve that is movable to close a fluidic outlet of the cement retainer to pressure test the cement retainer.

An aspect combinable with any other aspect can include the following features. The whipstock assembly includes a tube extending from the second fluid outlet of the whipstock assembly. The tube is configured to be removable attached to a fluid inlet of the cement retainer.

An aspect combinable with any other aspect can include the following features. The first seat is movable with respect to the cement retainer by fluidic pressure and the second seat is permanently attached to the whipstock assembly.

Certain aspects of the subject matter described here can be implemented as a method. A sidetracking assembly is disposed within a wellbore. The sidetracking assembly is fluidically coupled to a drill string configured to receive fluid from or near a surface of the wellbore. The drill string is attached to a milling system. The sidetracking assembly includes a cement retainer and a whipstock assembly releasably and fluidically coupled to the cement retainer and disposed between the cement retainer and the drill string. A first ball is deployed inside the drill string. The first ball is configured to leave the drill string to move past a ball seat of the whipstock assembly to land on a ball seat of the cement retainer to set the cement retainer. With the cement retainer sat, cement is flowed through the drill string to a portion of the wellbore downstream of the cement retainer to plug the portion of the wellbore. A second ball is deployed inside the drill string. The second ball includes a diameter larger than a diameter of the first ball such that the ball lands on the seat of the whipstock assembly to anchor the whipstock assembly. With the whipstock assembly anchored on the wellbore, the milling system is actuated to begin cutting a sidetrack window in the wellbore.

An aspect combinable with any other aspect can include the following features. Prior to flowing the cement and with the first ball blocking a first fluid outlet of the cement retainer, the cement retainer is set in the cased wellbore by applying fluidic pressure at the cement retainer to expand a packer of the cement retainer.

An aspect combinable with any other aspect can include the following features. A second fluid outlet of the cement retainer is exposed to fluidically couple the drill string to the portion of the cased wellbore downstream of the cement retainer.

An aspect combinable with any other aspect can include the following features. Prior to actuating the milling system and with the second ball blocking a second fluid outlet of the whipstock assembly, the whipstock assembly is anchored in the cased wellbore by applying fluidic pressure at the cement retainer to expand an anchor of the whipstock assembly.

BRIEF DESCRIPTION OF THE DRAWINGS

FIG. 9 shows a flow chart of an example method of cutting a sidetrack window in a cased wellbore.

DETAILED DESCRIPTION OF THE DISCLOSURE

The present disclosure relates to a well system and method for cutting a sidetrack window in a wellbore. The well system includes a sidetracking assembly that includes both a cement retainer and a window whipstock assembly disposed upstream of the cement retainer. The sidetracking assembly is connected to a drill string. The well system is used to plug a wellbore and make a casing window in one trip. The cement retainer is set hydraulically by 1) dropping a small ball that plugs an outlet of the cement retainer and 2) applying pressure in the string to expand the packers of the cement retainer. With the cement retainer sat, the cement stinger is sheared and picked up, the pipe rams are closed and the cement retainer is pressure tested from above. The cement retainer is then stung back and cement is injected through the outlet of the cement retainer to plug the wellbore. After plugging the wellbore, the whipstock assembly is pulled to desired sidetrack window, oriented to desired azimuth and anchored to the casing by 1) dropping a large ball that plugs an outlet of the whipstock and 2) applying pressure in the string to expand or activate an anchoring system of the whipstock. With the anchoring system engaged, a milling system (for example, a 3 window mills space out) attached to the drill string can mill and cut the casing window to initiate the sidetrack wellbore.

Implementations of the present disclosure may realize one or more of the following advantages. For example, the well system can save time and resources by plugging a wellbore and drilling a sidetrack wellbore all during one trip. A whipstock can be utilized without a packer, thereby achieving significant cost savings compared to utilizing a whipstock with a packer.

Figure 1:
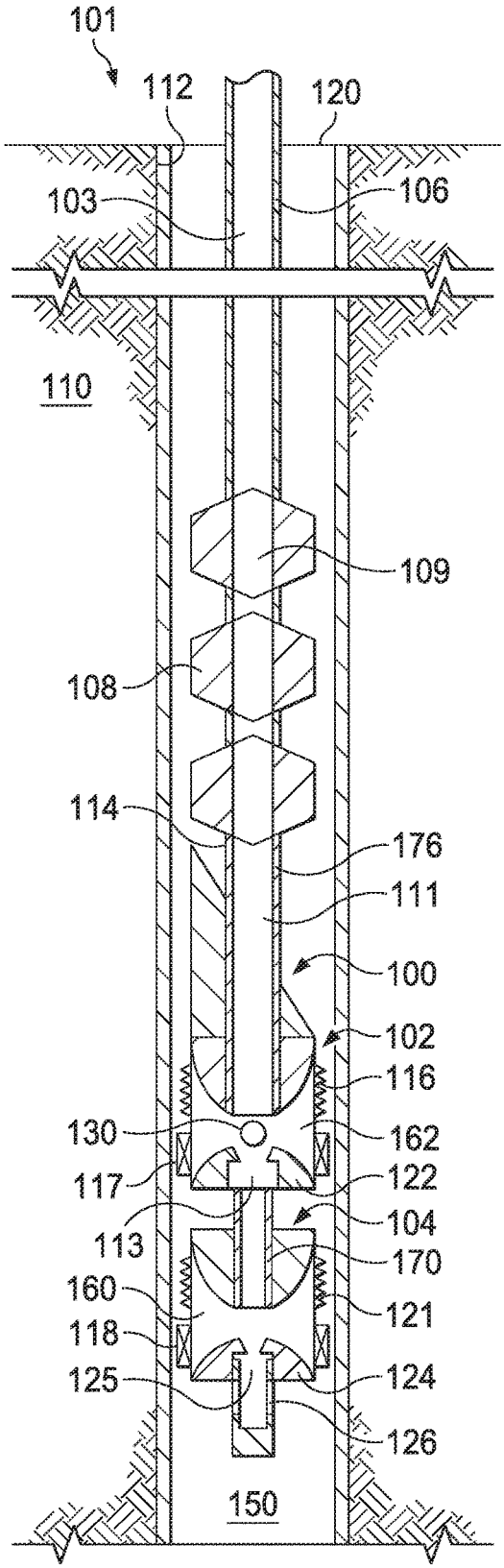
FIGS. 1-8 are front, cross sectional views of a sidetracking assembly deployed in a cased wellbore, illustrating sequential steps for cutting a sidetrack window in a cased wellbore.

FIGS. 1-8 illustrate sequential steps for cutting a sidetrack window in a cased wellbore 112 using a well system 101. As shown in FIG. 1, the well system 101 includes a drill string 106 attached to a sidetracking assembly 100 that can be deployed in a wellbore 112 (for example, a cased wellbore). The wellbore 112 is formed in a geologic formation 110. The geologic formation 110 includes a hydrocarbon reservoir or formation (not shown) from which hydrocarbons can be extracted. The drill string 106 extends from a surface 120 of the wellbore 112 and receives fluid from or near the surface 120 of the wellbore 112. For example, the drill string 106 can be connected to a mud pump (not shown) or similar equipment at the surface 120 of the wellbore 112. The drill string 106 includes a drill pipe or drill pipes that flows fluid from the surface 120 to a downhole location of the wellbore 112. The drill string 106 is connected to a milling system 108 (for example, a 3 mills system with a 3 window mills space out). The milling system 108 can be attached to the drill string 106 at or near a far end 114 of the drill string 106. The sidetracking assembly 100 can be attached to the far end 114 of the drill string 106. The sidetracking assembly 100 is connected to the drill string 106. As further described later with respect to FIGS. 2-5, the sidetracking assembly 100 is used to place a cement plug below the cement retainer and to allow the milling system 108 to cut a window in the cased wellbore 112.

Still referring to FIG. 1, the sidetracking assembly has a cement retainer 104 and a whipstock assembly 102 releasable and connected to the cement retainer 104. The string 106 has an interior fluid channel 103 that is in fluid communication, through the milling system 108 and the whipstock assembly 102, with the cement retainer 104. In other words, the components of the sidetracking assembly 100, when attached, form a central fluid pathway that extends from the drill string 106 to the cement retainer 104. For example, the milling system 108 defines an interior fluid channel 109 that is in fluid communication with the interior channel 103 of the drill string at one end and with an interior fluid channel 111 of the whipstock assembly 102 at an opposite end. The interior fluid channel 111 of the whipstock assembly 102 is in fluid communication with a pipe 170 that extends from a fluid outlet 113 of the whipstock assembly 102. The pipe 170 of the whipstock assembly 102 is in fluid communication with an interior compartment 160 of the cement retainer 104.

As shown in FIG. 1, the cement retainer 104 has one or more packers 118 that are activable by fluidic pressure. For example, fluidic pressure applied at an interior compartment 160 of the cement retainer 104 causes the packers 118 to expand to set the cement retainer 104 in the wellbore 112. To expand the packers 118 of the cement retainer 104, the cement retainer 104 is closed off such that fluidic pressure at the string 106 applies fluidic pressure at the interior compartment 160. For example, the cement retainer 104 has a first ball seat 124 that supports a first ball 130 that is deployed through the string 106 to land on the ball seat 124. The ball seat 124 defines a first fluid outlet 125 sized to receive a portion of the first ball 130 such that, with the ball 130 sat on the ball seat 124, blocks the first fluid outlet 125 to allow fluidic pressure at the string 106 to expand the packer 118 to set the cement retainer 104 in the wellbore 112. The cement retainer 104 can also include one or more anchors 121 that expand with fluidic pressure to anchor the cement retainer to the wellbore 112.

The whipstock assembly 102 is disposed between the cement retainer 104 and the drill string 106. The whipstock assembly 102 is releasably and fluidically coupled to the cement retainer 104. For example, the pipe 170 of the whipstock assembly 102 is attached to the cement retainer 104 with pins that can be sheared off from the cement retainer 104 by pulling the whipstock assembly 102 away from the cement retainer 104. The whipstock assembly 102 can separate from the cement retainer 104 to allow the well system 101 to do at least one of the following: 1) after setting the cement retainer, pressure test the cement retainer 104 and 2) after forming the cement plug, anchoring the whipstock assembly 102 in the wellbore 112. The whipstock assembly 102 has one or more anchors 116 that are activable by fluidic pressure similar to the packer 118 of the cement retainer 104. For example, fluidic pressure applied at an interior compartment 162 of the whipstock assembly 102 causes the anchor 116 to expand to anchor the whipstock assembly 102 to the wellbore 112. To expand the anchor 116 of the whipstock assembly 102, the whipstock assembly 102 is closed off such that fluidic pressure at the string 106 applies fluidic pressure at the interior compartment 162. For example, as further described in detail later with respect to FIG. 7, the whipstock assembly 102 has a second ball seat 122 that defines a second fluid outlet 113 sized to allow the first ball 130 to pass through the second fluid outlet 113 but stop a second ball larger than the first ball. The second ball blocks the second fluid outlet 113 of the whipstock assembly 102 to allow fluidic pressure at the drill string 106 to expand the anchor 116 to anchor the whipstock assembly 102 to the wellbore 112. The whipstock assembly 102 can also include one or more packers 117 that expand with fluidic pressure to set the whipstock assembly 102 in the wellbore 112.

As shown in FIG. 1, the anchor 116 of the whipstock assembly 102 has shear pins to prevent the anchor 116 from expanding when applying pressure at the string to expand the packers of the cement retainer. To do so, the shear pins can be set at higher setting pressure than the cement retainer.

Figure 2:
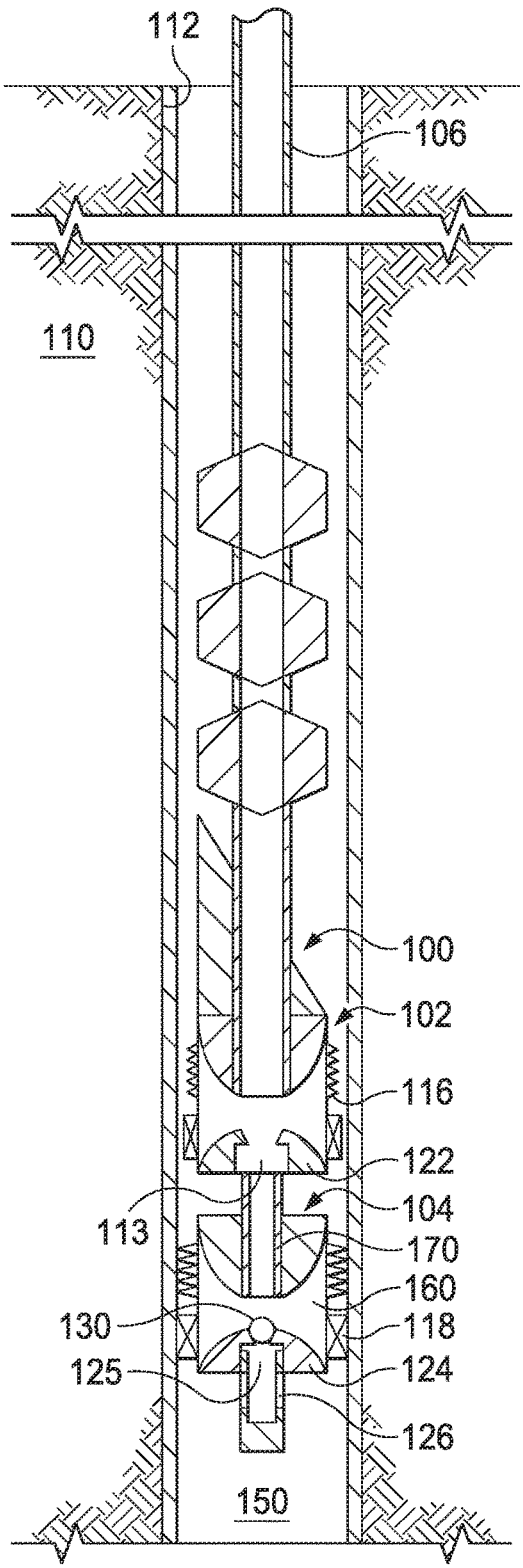

As shown in FIG. 2, after the sidetracking assembly 100 is deployed within the cased wellbore 112, the sidetracking assembly 100 can be positioned within the wellbore 112 at a desired location to set the cement retainer 104. The sidetracking assembly 100 can have a general purpose inclinometer tool (not shown) to orient the sidetracking assembly on the desired azimuth. For example, the sidetracking assembly is oriented on surface to the desired direction and can be adjusted if required, before setting the whipstock by turning the assembly from surface. The sidetracking assembly is oriented along a longitudinal axis of the sidetracking assembly to arrange the assembly in a desired position. To set the cement retainer 104, a first ball 130 can be dropped or deployed from the surface 120 of the wellbore 112 inside the drill string 106. FIG. 1 shows the first ball 130 moving or falling past the ball seat 122 of the whipstock assembly 102 to land on the ball seat 124 of the cement retainer 104. As shown in FIG. 2, the first ball 130 lands on the ball seat 124 of the cement retainer 104 to block the fluid outlet 125 of the cement retainer 104. With the fluid outlet 125 of the cement retainer 104 blocked, the cement retainer 104 is set in the cased wellbore by applying fluidic pressure, from the drill string 106, at the cement retainer 104 to expand the packer 118. As further described earlier, the anchor 116 of the whipstock assembly 102 is activable by a fluidic pressure larger than the fluidic pressure that activates the packer 118, such that expanding the packer 118 does not expand the anchor 116.

Figure 3:
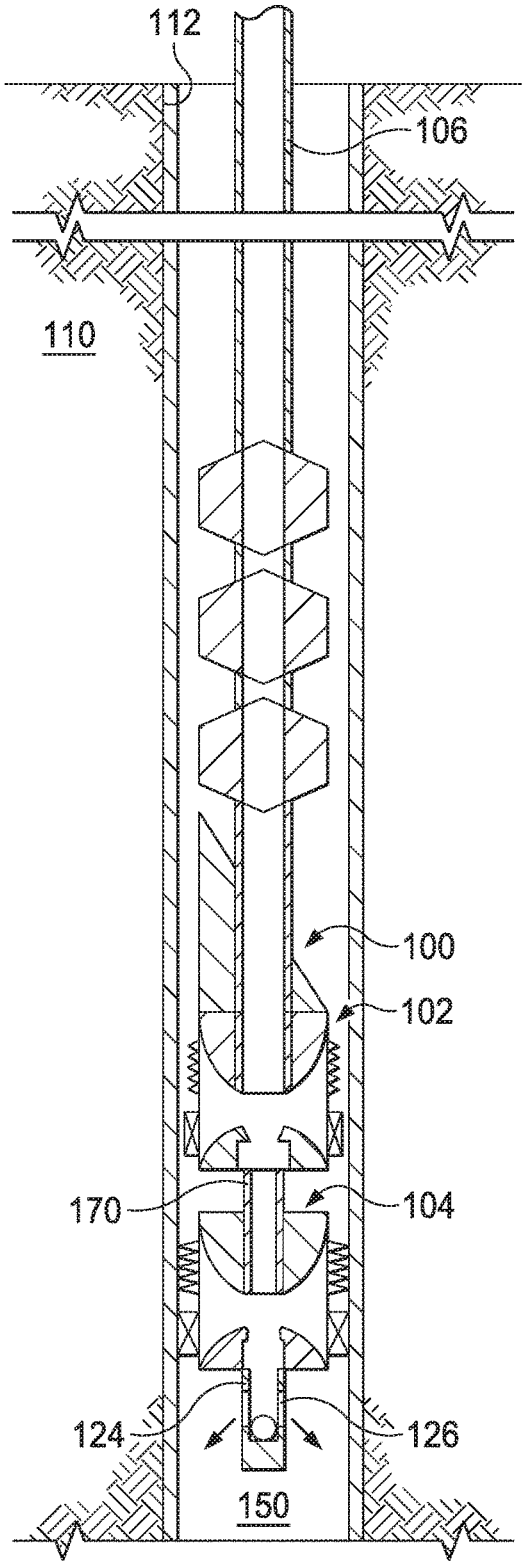

Referring to FIG. 3, the ball seat 124 of the cement retainer 104 is sheared off from the cement retainer 104 by continuing to apply fluidic pressure to open a fluid path between the drill string 106 and the wellbore 112. For example, the ball seat 124 can be attached with pins to the cement retainer 104 such that fluidic pressure applied after setting the cement retainer shears off the pins and pushes the seat 124 away from the cement retainer 104. As the ball seat 124 is sheared off from the cement retainer 104, one or more fluid outlets 126 are exposed or opened to allow cement to be injected in a portion 150 of the wellbore 112 downstream of the cement retainer. With the outlet 126 opened, the cement retainer 104 is fluidically coupled to the portion 150 of the cased wellbore downstream of the cement retainer 104.

Figure 4:
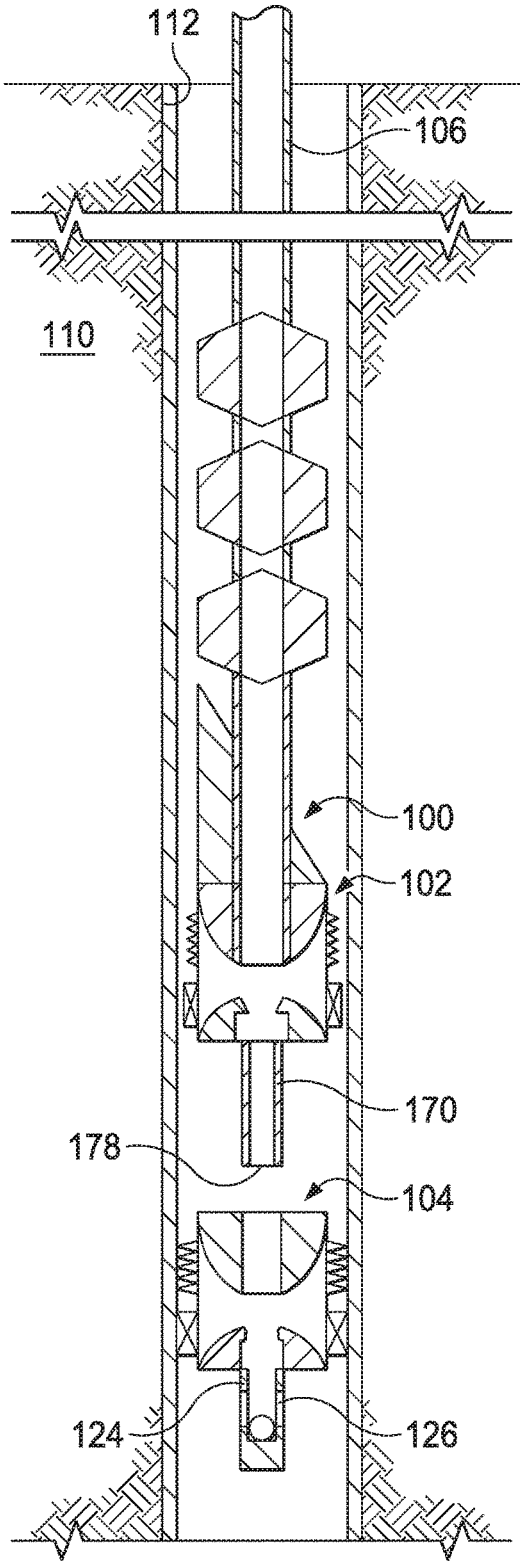

As shown in FIG. 4, after exposing the second outlet 126 of the cement retainer 104, the whipstock assembly 102 (and by extension the tube 170 of the whipstock assembly) is sheared off or separated from the cement retainer 104 to pressure test the cement retainer 104. For example, the whipstock assembly 102 is separated from the cement retainer 104 by pulling the whipstock assembly 102 away from the cement retainer 104 to shear off an outlet 178 of the whipstock assembly or the tube 170 of the whipstock assembly 102 from the cement retainer 104. The internal sleeve of the packer can be closed to pressure test the cement retainer. For example, the packer is spring loaded whenever the stinger is out of the cement retainer. The stinger will close the sleeve once it is stung out and open once it is stung in.

Figure 5:
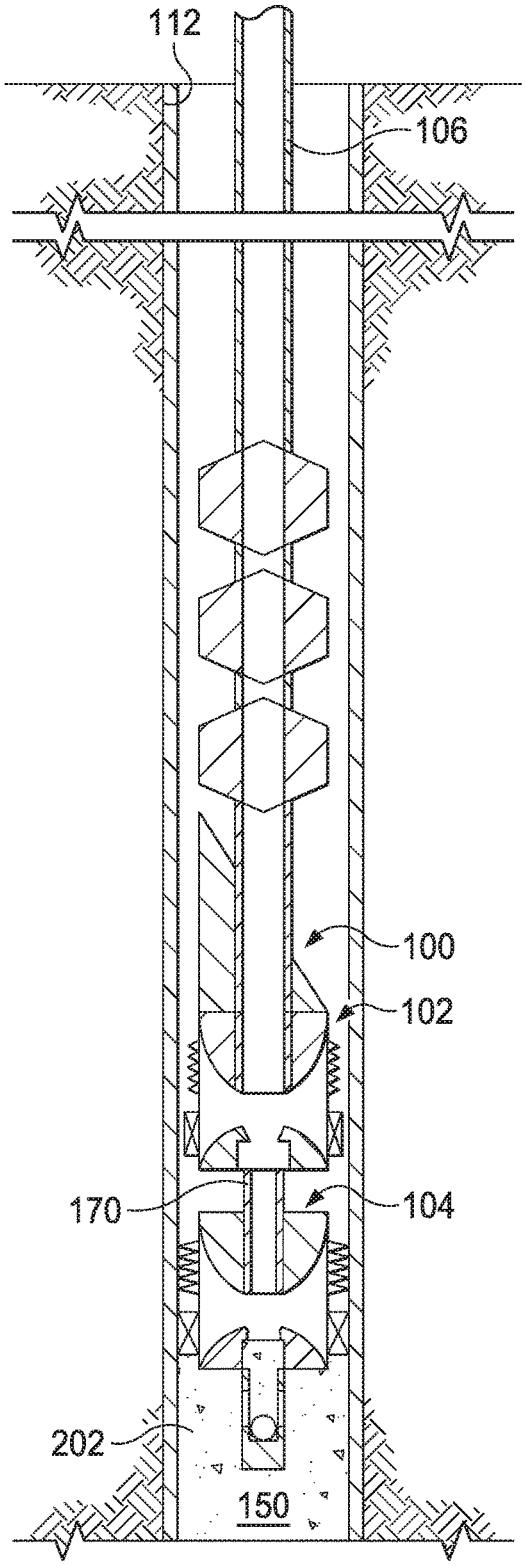
Figure 6:
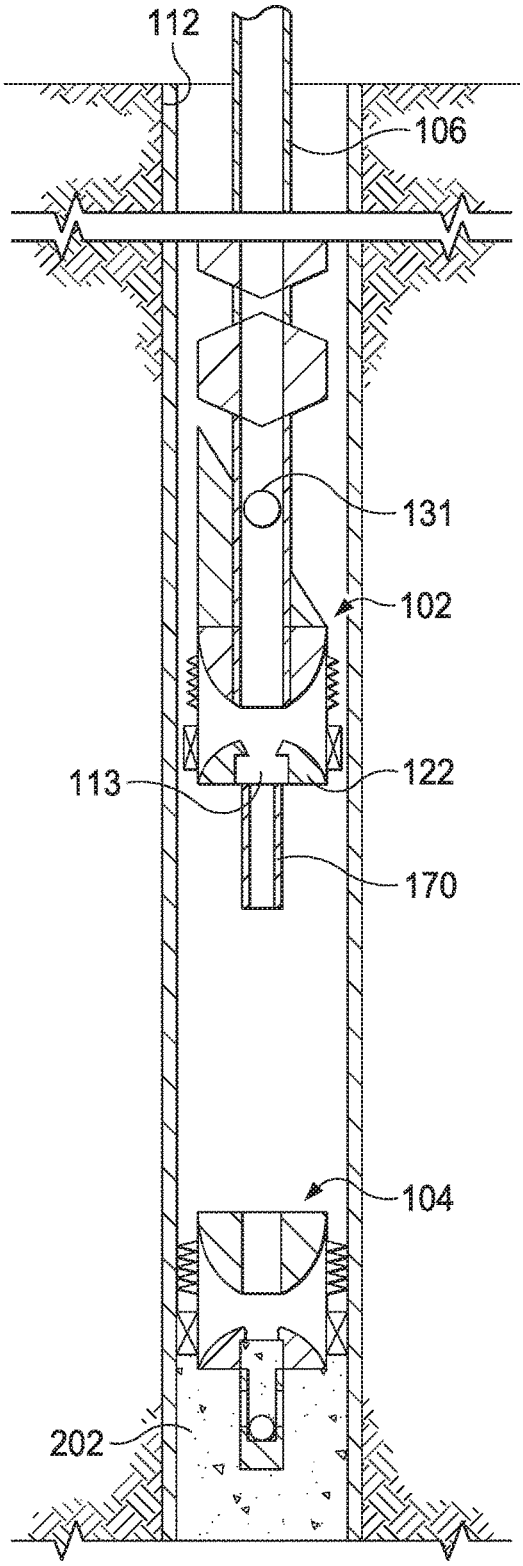

Referring to FIG. 5, after pressure testing the cement retainer 104, the whipstock assembly 102 is lowered to attach the tube 170 of the whipstock assembly 102 to the cement retainer 104. With the tube engaged 170, cement 202 or a cement-containing material is flown through the drill string 106 and through the sidetracking assembly 100 to the portion 150 of the cased wellbore downstream of the cement retainer 104 to plug the portion 150 of the wellbore 112. As shown in FIG. 6, after cementing or plugging the wellbore 112, the whipstock assembly 102 is separated again from the cement retainer 104. The whipstock assembly 102 separated from the cement retainer 104 is positioned at a desired location along the cased wellbore 112 upstream of the cement retainer 104. For example, the whipstock assembly 102 is moved away from the cement retainer 104 a desired distance to a location where the sidetrack window is to be cut. With the whipstock assembly 102 at the determined location, a second ball 131 larger than the first ball 130 (see FIG. 1) is deployed inside the drill string 106 to anchor the whipstock assembly 102. The second ball 131 has a diameter larger than a diameter of the first ball such that the second ball 131 lands on the seat 122 of the whipstock assembly to block a fluid outlet 113 of the whipstock assembly 102.

Figure 7:
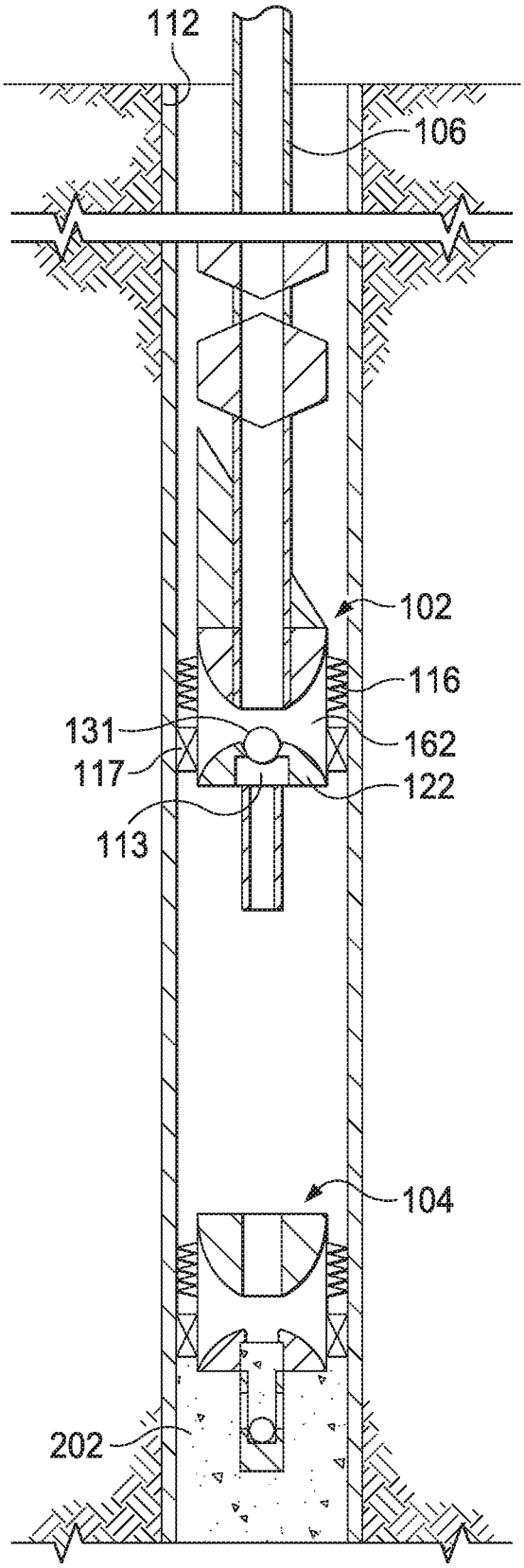

FIG. 7 shows the second ball 131 supported on the ball seat 122, covering the fluid outlet 113 of the whipstock assembly 102. The second seat 122 is permanently attached to the whipstock assembly 102. Similar to the first ball (for example, the small ball) that is used to set the cement retainer, the second ball 131 is used to anchor the whipstock assembly 102. For example, the fluid outlet 113 defined by the ball seat 122 is sized to receive a portion of a second ball 131 such that the second ball 131 blocks the fluid outlet 113 of the whipstock assembly 102 to allow fluidic pressure at the string 106 to expand the anchor 116 and packer 117 to anchor the whipstock assembly 102 in the wellbore 112. To expand the anchor 116, a second fluid, for example, the same as the first fluid, is flown through the drill string 106 to apply fluidic pressure at an interior compartment 162 of the whipstock assembly 102 to expand the anchor 116 of the whipstock assembly 102.

Figure 8:
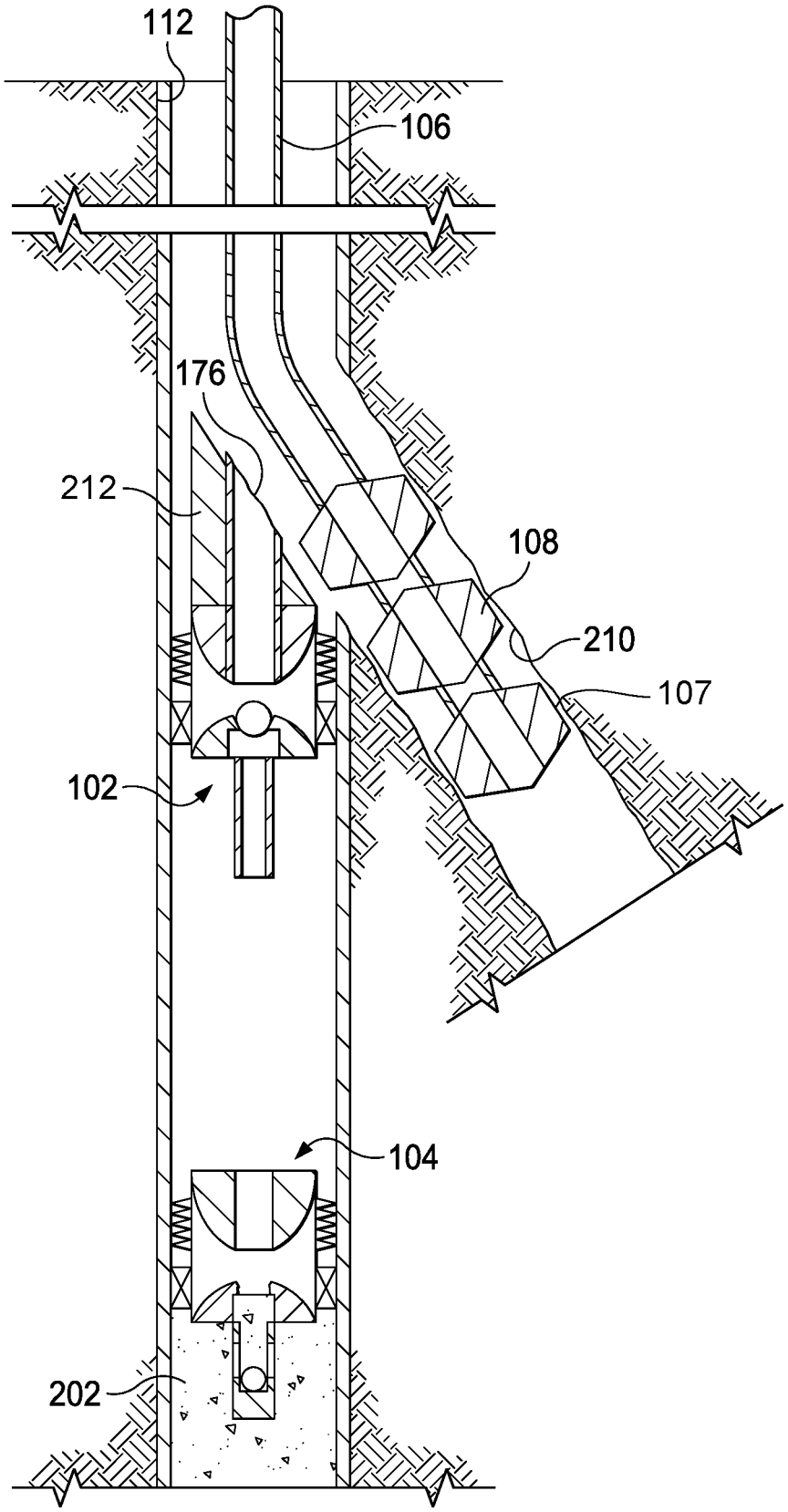

FIG. 8 shows the drill bit 107 cutting a sidetrack window 210 through the cased wellbore 112. After anchoring the whipstock assembly, a ramp 212 of the whipstock assembly 102 can be rotated to guide or deflect the milling system 108 along a desired direction. Before actuating the milling system 108, the milling system 108 can be separated from the whipstock assembly 102. For example, the whipstock assembly 102 is releasably coupled to the drill string 106 through an aluminum stinger 176 of the whipstock assembly 102, and before actuating the drill bit 107 the drill string 106 is decoupled from the stinger 176. To separate the drill string 106 from the whipstock assembly 102, a ball is dropped through the string to activate the anchoring system. After anchoring the whipstock, an overpull is applied and the pins are sheared to disengage the milling system from the aluminum stinger, which is attached to the whipstock assembly and pinned to the milling system. After removing the milling system 108 from the whipstock assembly 102, the drill bit 107 is actuated to mill or cut the stinger 176 of the whipstock assembly 102. After or when milling the stinger 176, the drill bit 107 begins cutting a sidetrack window in the cased wellbore.

FIG. 9 shows a flow chart of an example method 300 of cutting a sidetrack window in a cased wellbore. The method includes disposing a sidetracking assembly within a cased wellbore (305). The method also includes deploying a first ball inside the drill string, the first ball configured to leave the drill string to move past a ball seat of the whipstock assembly to land on a ball seat of the cement retainer to block a first fluid outlet of the cement retainer (310). The method also includes setting the cement retainer in the cased wellbore by applying fluidic pressure at the cement retainer to expand the packer (315). The method also includes increasing pressure to shear the ball seat of the cement retainer and re-establishing fluid injection through the outlet of the cement retainer to fluidically couple the drill string to a portion of the cased wellbore downstream of the cement retainer (320). The method also includes applying overpull on the work string to shear the stinger of the whipstock out of the internal bore of the cement retainer and establishing circulation inside the wellbore (325). The wellbore is pressure tested above the cement retainer to confirm its sealing integrity. The method also includes lowering the work string and stinging into the cement retainer with the stinger attached to the bottom of the whipstock (330). In this manner, injection into the bottom section of the wellbore can be established and re-confirmed. The method also includes flowing cement through the drill string to the portion of the cased wellbore downstream of the cement retainer to plug the portion of the wellbore (335). The method also includes separating the whipstock assembly from the cement retainer (340). The method also includes deploying a second ball inside the drill string (345). The second ball has a diameter larger than that of the first ball such that the second ball lands on the seat of the whipstock assembly to block a fluid outlet of the whipstock assembly. The method also includes anchoring the whipstock assembly in the cased wellbore by applying fluidic pressure at the cement retainer to expand the anchor of the whipstock assembly (350). The method includes applying overpull on the work string to shear the pin connecting the lead mill to the tip of the whipstock (355). The string and the mills can be pulled to confirm disengagement. Rotation on the string can be started to actuate the mills to begin cutting a sidetrack window in the cased wellbore.

Although the following detailed description contains many specific details for purposes of illustration, it is understood that one of ordinary skill in the art will appreciate that many examples, variations and alterations to the following details are within the scope and spirit of the disclosure. Accordingly, the exemplary implementations described herein and provided in the appended figures are set forth without any loss of generality, and without imposing limitations on the claimed implementations. For example, the implementations are described with reference to a gas turbine. However, the disclosure can be implemented with any rotary equipment that includes a rotating shaft or rotor that needs to be aligned with a rotating shaft or rotor of another rotary equipment.

Although the present implementations have been described in detail, it should be understood that various changes, substitutions, and alterations can be made hereupon without departing from the principle and scope of the disclosure. Accordingly, the scope of the present disclosure should be determined by the following claims and their appropriate legal equivalents.

The singular forms "a", "an" and "the" include plural referents, unless the context clearly dictates otherwise.

Optional or optionally means that the subsequently described event or circumstances may or may not occur. The description includes instances where the event or circumstance occurs and instances where it does not occur.

Ranges may be expressed herein as from about one particular value, or to about another particular value or a combination of them. When such a range is expressed, it is to be understood that another implementation is from the one particular value or to the other particular value, along with all combinations within said range or a combination of them.

Throughout this application, where patents or publications are referenced, the disclosures of these references in their entireties are intended to be incorporated by reference into this application, in order to more fully describe the state of the art to which the disclosure pertains, except when these references contradict the statements made herein.

As used herein and in the appended claims, the words "comprise," "has," and "include" and all grammatical variations thereof are each intended to have an open, non-limiting meaning that does not exclude additional elements or steps.

As used herein, terms such as "first" and "second" are arbitrarily assigned and are merely intended to differentiate between two or more components of an apparatus. It is to be understood that the words "first" and "second" serve no other purpose and are not part of the name or description of the component, nor do they necessarily define a relative location or position of the component. Furthermore, it is to be understood that that the mere use of the term "first" and "second" does not require that there be any "third" component, although that possibility is contemplated under the scope of the present disclosure.

That which is claimed is:

1. A method comprising:

disposing a sidetracking assembly within a cased wellbore, the sidetracking assembly releasably and fluidically coupled to a drill string configured to receive fluid from or near a surface of the wellbore, the drill string comprising a milling system, the sidetracking assembly comprising a cement retainer and a whipstock assembly releasably and fluidically coupled to the cement retainer and disposed between the cement retainer and the drill string, the drill string releasably attached to the whipstock assembly, the whipstock assembly comprising an anchor activable by fluidic pressure and the cement retainer comprising a packer activable by fluidic pressure;

deploying a first ball inside the drill string, the first ball configured to leave the drill string to move past a ball seat of the whipstock assembly to land on a ball seat of the cement retainer to block a first fluid outlet of the cement retainer;

with the fluid outlet of the cement retainer blocked, setting the cement retainer in the cased wellbore by applying fluidic pressure at the cement retainer to expand the packer;

exposing a second fluid outlet of the cement retainer to fluidically couple the drill string to a portion of the cased wellbore downstream of the cement retainer;

flowing cement through the drill string, to the portion of the cased wellbore downstream of the cement retainer to plug the portion of the wellbore;

separating the whipstock assembly from the cement retainer;

deploying a second ball inside the drill string, the second ball comprising a diameter larger than a diameter of the first ball such that the second ball lands on the seat of the whipstock assembly to block a fluid outlet of the whipstock assembly;

with the fluid outlet of the whipstock assembly blocked, anchoring the whipstock assembly in the cased wellbore by applying fluidic pressure at the cement retainer to expand the anchor of the whipstock assembly;

detaching the drill string from the whipstock assembly; and with the whipstock assembly anchored on the cased wellbore and the drill string detached from the whipstock assembly, actuating the milling system of the drill string to begin cutting a sidetrack window in the cased wellbore.

2. The method of claim 1, further comprising, prior to flowing cement through the drill string:

separating the whipstock assembly from the cement retainer; and pressure testing the cement retainer.

3. The method of claim 1, further comprising, after separating the whipstock assembly from the cement retainer and prior to deploying the second ball, positioning the whipstock assembly at a desired location along the cased wellbore upstream of the cement retainer.

4. The method of claim 1, further comprising, prior to actuating the milling system, separating the drill string from the whipstock assembly.

5. The method of claim 4, wherein the whipstock assembly is releasably coupled to the drill string through a stinger of the whipstock assembly, and wherein actuating the milling system of the drill string to begin cutting the sidetrack window comprises milling, with the milling system, the stinger of the whipstock assembly.

6. The method of claim 1, wherein setting the cement retainer comprises flowing a first fluid through the drill string to apply fluidic pressure at the cement retainer to expand the packer of the cement retainer and set the cement retainer in the cased wellbore.

7. The method of claim 1, wherein anchoring the whipstock assembly comprises flowing a second fluid through the drill string to apply fluidic pressure at the whipstock assembly to expand the anchor of the cement retainer and anchor the whipstock assembly in the cased wellbore.

8. The method of claim 1, wherein exposing the outlet of the cement retainer comprises continuing to flow the first fluid to move the ball seat away from the cement retainer and expose an outlet of the cement retainer to fluidically couple the drill string to the portion of the cased wellbore downstream of the cement retainer.

9. The method of claim 1, wherein separating the whipstock assembly from the cement retainer comprises pulling the whipstock assembly away from the cement retainer to shear off an outlet of the whipstock assembly from the cement retainer.

10. A well system for cutting a sidetrack window in a cased wellbore, the system comprising:

a drill string configured to receive fluid from or near a surface of the wellbore, the drill string coupled to a milling system; and a sidetracking assembly releasably and fluidically coupled to the drill string, the sidetracking assembly configured to form a cement plug to allow the milling system to cut a window in the cased wellbore, the sidetracking assembly comprising a cement retainer comprising a packer activable by fluidic pressure, the cement retainer comprising a first ball seat configured to support a first ball configured to block a first fluid outlet of the cement retainer to allow fluidic pressure at the string to expand the packer to set the cement retainer in the wellbore; and a whipstock assembly releasably and fluidically coupled to the cement retainer and disposed between the cement retainer and the drill string, the whipstock assembly configured to separate from the cement retainer to allow the well system to do at least one of 1) pressure test the cement retainer and 2) anchor the whipstock assembly in the wellbore after flowing cement downstream of the cement retainer to plug the wellbore, the whipstock assembly comprising an anchor activable by fluidic pressure, the whipstock assembly comprising a second ball seat comprising a second fluid outlet sized to allow the first ball to pass through the second fluid outlet but stop a second ball larger than the first ball, the second ball configured to block the second fluid outlet of the whipstock assembly to allow fluidic pressure at the drill string to expand the anchor to anchor the whipstock assembly in the wellbore;

wherein the drill string is releasably coupled to the whipstock assembly such that, with the whipstock assembly anchored, the drill string detaches from the whipstock assembly to mill a sidetrack window in the cased wellbore.

11. The well system of claim 10, wherein the whipstock assembly is releasably coupled to the drill string through a drillable stinger of the whipstock assembly.

12. The well system of claim 10, wherein the packer of the cement retainer is designed at a shear rating pressure value permitting the packer to be expanded by fluid pressure without shearing off the first ball seat.

13. The well system of claim 10, wherein the anchor of the whipstock assembly is configured such that the anchor is activable by a fluidic pressure larger than the fluidic pressure that activates the packer of the cement retainer.

14. The well system of claim 10, wherein the cement retainer comprises an internal sleeve that is movable to close a fluidic outlet of the cement retainer to pressure test the cement retainer.

15. The well system of claim 10, wherein the whipstock assembly further comprises a tube extending from the second fluid outlet of the whipstock assembly, the tube configured to be removable attached to a fluid inlet of the cement retainer.

16. The well system of claim 10, wherein the first seat is movable with respect to the cement retainer by fluidic pressure and the second seat is permanently attached to the whipstock assembly.

17. A method comprising:

disposing a sidetracking assembly within a wellbore, the sidetracking assembly releasably and fluidically coupled to a drill string configured to receive fluid from or near a surface of the wellbore, the drill string attached to a milling system, the sidetracking assembly comprising a cement retainer and a whipstock assembly releasably and fluidically coupled to the cement retainer and disposed between the cement retainer and the drill string, the drill string releasably attached to the whipstock assembly;

deploying a first ball inside the drill string, the first ball configured to leave the drill string to move past a ball seat of the whipstock assembly to land on a ball seat of the cement retainer to set the cement retainer;

with the cement retainer sat, flowing cement through the drill string, to a portion of the wellbore downstream of the cement retainer to plug the portion of the wellbore;

deploying a second ball inside the drill string, the second ball comprising a diameter larger than a diameter of the first ball such that the second ball lands on the seat of the whipstock assembly to anchor the whipstock assembly;

detaching the drill string from the whipstock assembly; and with the whipstock assembly anchored on the wellbore, actuating the milling system to begin cutting a sidetrack window in the wellbore.

18. The method of claim 17, further comprising, prior to flowing the cement and with the first ball blocking a first fluid outlet of the cement retainer, setting the cement retainer in the cased wellbore by applying fluidic pressure at the cement retainer to expand a packer of the cement retainer.

19. The method of claim 18, further comprising exposing a second fluid outlet of the cement retainer to fluidically couple the drill string to the portion of the cased wellbore downstream of the cement retainer.

20. The method of claim 17, further comprising, prior to actuating the milling system and with the second ball blocking a second fluid outlet of the whipstock assembly, anchoring the whipstock assembly in the cased wellbore by applying fluidic pressure at the cement retainer to expand an anchor of the whipstock assembly.

* * * * *